United States Patent [19]

Goodman, Jr.

[11] Patent Number: 5,069,256

[45] Date of Patent: Dec. 3, 1991

[54] LOOM HARNESS SYSTEM WITH SPACED PARALLEL ROTATING SHAFTS

[76] Inventor: Robert M. Goodman, Jr., 581 Kennesaw Ave., Marietta, Ga. 30060

[21] Appl. No.: 447,836

[22] Filed: Dec. 8, 1989

[51] Int. Cl.[5] ..... D03C 13/00

[52] U.S. Cl. ..... 139/83; 139/55.1; 139/66 R; 139/88; 139/91

[58] Field of Search ..... 139/55.1, 66 R, 66 A, 139/82, 83, 84, 88, 91, 29, 33, 30, 33.5, 34, 11, 50, 85, 1 R, 457–460, 65, 71, 87, 89

[56] References Cited

U.S. PATENT DOCUMENTS

| | | | |
|---|---|---|---|
| 753,808 | 3/1904 | Patten | 139/83 |
| 2,232,312 | 2/1941 | Brooks | 139/33 |
| 2,379,743 | 7/1945 | Payne | 139/55.1 |
| 3,137,320 | 6/1964 | Parton | 139/33 |
| 3,774,649 | 11/1973 | Glessner | 139/33 |

FOREIGN PATENT DOCUMENTS

| | | | |
|---|---|---|---|
| 2479859 | 10/1981 | France | 139/29 |

*Primary Examiner*—Andrew M. Falik

*Attorney, Agent, or Firm*—Hopkins & Thomas

[57] ABSTRACT

A loom harness having nested pairs of cylinders. The pairs of cylinders are arranged in parallel fashion and offset in relation to one another on a rigid, stationary frame. Pillow blocks spaced along the frame support the cylinders. Flexible cables, connect the pairs of nested cylinders and support heddle eyes at their approximate midpoints. Alternatively, the cables can support heddle frames which, in turn, carry wire heddles. Control cables are attached to the upper and lower cylinders, and are moved upwardly or downwardly by a dobby. An alternative control includes an A-C servo motor and drive shafts to move the cylinders. The selective rotation of the various pairs of nested cylinders causes the translation of the heddle eyes. This movement of the heddle eyes causes a shed to be created in the warp yarn passing through the eyes.

42 Claims, 11 Drawing Sheets

LOOM HARNESS SYSTEM WITH SPACED PARALLEL ROTATING SHAFTS

BACKGROUND OF THE INVENTION

1. Field of the Invention

This invention relates to an improved loom harness, and a method for moving or translating warp yarn to form a shed. The apparatus includes a rigid, non-moving support frame which supports, in journalled fashion, spaced, parallel shafts. The shafts carry corresponding arcuate pulley members, between which run cables carrying lightweight heddle frames or carrying mail eye heddles, each pair forming a scroll. The scrolls are arranged in a nested manner on the non-moving frame. The scrolls can be selectively actuated to apply either an upward or downward force in tension to selectively translate the warp yarn to form the desired shed.

2. Description of the Prior Art

Various means have been previously utilized for shedding in weaving looms. Prior looms have included numerous, large moving support frames having upward and lower parallel shafts connected by end pieces, which support transverse heddle rods carrying vertical heddles therebetween. These moving frames have rigid or semirigid joints capable of transferring moment forces, and are commonly referred to as compact frames These rigid support frames are utilized to support the heddle rods, which maintain the eyes of each respective heddle both in a straight line and parallel to one another during shedding and at rest. Numerous support frames are grouped together with the warp yarn of the weaving loom passing through successive heddle eyes. Each support frame must be mechanically shifted either upwardly or downwardly in its entirety in order to create the shed. Many high speed looms currently used today, also employ rigid, moving support frames In the past, when the typical weave rate was 60 to 100 picks per minute, the structural integrity of the support frames was not as critical as in present weaving loom frames. The prior support frames normally lasted for many years, and could be readily repaired by replacing one or more damaged components. Over the years, improvements in looms, especially in passing the weft yarn through the shed, have resulted in greatly increased weaving rates. Today, weaving looms of up to six feet in width which utilize movable support frames can achieve a cyclic weaving rate of 400 to 1,000 picks per minute, which is considered a high speed loom. This increase in weaving rate has dramatically increased the stress to which the support frames are subjected during the weaving action. This result in these higher stresses therefore, results in greatly increased fatigue and wear of the support frames and their associating biasing mechanisms.

During high speed weaving, the portion of the equipment providing the driving forces necessary to shift the support frames vertically up or down into the proper position must handle the vertical positioning of a large number of frames. High acceleration and deceleration forces are required to translate the support frames in a near vertical plane from the highest shed position to the lowest shed position. These movements must be accomplished during each pick. These forces create both deflection and stress in the frames and result in eyes which are unaligned.

To accomplish the weaving pattern desired, a dobby mechanism is frequently incorporated into the weaving machine to pull the support frames from their lowest position to their highest or upper position. The dobby works against forces of springs which provide the stored energy required to push the frames downward to their lowered position, when the dobby mechanism allows. The connecting link between the final crank of the dobby and the dobby lever is typically a cable which can exert force only in tension, and therefore is used to pull each frame into its uppermost position and also extend the tension springs, storing energy for the downward movement.

The high speed weaving machines of today use the support frames to support and position a large number of heddles, each heddle having an eye through which one end of the warp yarn passes. Many difficulties are also experienced in the service life of the heddles, which can fail due to fatigue, wear or other damage because of stresses transferred to the heddles by the current support frames. The modern heddles most used today are long, thin, flat stamped sheet metal elements which engage at either end the heddle rod supported by the shaft of the frame. The heddles are supported in a horizontal row, which may contain a thousand or more heddles A less frequently used alternative to the stamped, flat heddle is the mail eye wire or string heddle, which is also well suited for use with the invention described herein.

In an effort to compensate for the shorter life of and fatigue failures in the support frames, many changes have been made in their mechanical design in order to resist the effects of the increased stresses resulting from higher weaving rates. These changes have included utilizing stronger materials for the support frames, such as heat-treated aluminum alloy extrusions. Other advances now being tested have been to incorporate carbon fiber and other composite technology in the making of shafts. Even these newer support frame designs, however, are experiencing fatigue failures within unacceptably short service life. This fact, together with the higher cost of the modern-day support frames, necessitates that increasing weave rates above the rate achieved in today's weaving looms utilizing support frames, may be neither mechanically nor economically feasible. Therefore, while it may be possible to drive support frames at faster rates with corresponding advancements in inserting the weft yarn, it may be impractical to use high-technology support frames in high-speed weaving, because the support frames themselves had reached a fatigue limit barrier and are economically prohibitive.

In another prior art weaving loom, known as a Draper XP-2 Loom, a pair of rectangular support frames having shafts which support heddle rods and heddles are shifted in opposite directions, one up and the other down, to form a shed by a cam driven treadle system. One of the treadles is attached to the bottom of the first support frame, and the second treadle is attached to the bottom of the second frame with the top of the pair of frames connected to each other by flexible connection means over the top of a rotatable cylinder mounted at the ends in a horizontal position. A lever, or treadle, is attached at one end to each of the two frames, and driven near its other, pivoted end by a cam. The rotation of the cam drives one treadle downward and one frame down. This downward movement of one frame pulls the other frame upwardly, which is allowed upward movement by the other cam through the associated treadle. Major disadvantages of this device are: (1) that the gage or horizontal separation between the frames is controlled by the diameter of the cylinder; (2) it is adaptable to looms which utilize only two frames; and (3) the horizontal rotating cylinder is supported only at the ends. This type of machine is useful only in the simplest weaving operations, such as weaving non-patterned cloth.

In other prior art devices, various means are employed to shift rows of mail eye heddles without utilizing support frames. For example, U.S. Pat. No. 4,440,196 to Arvai, discloses an open-shed Jacquard machine having multiple modules of pulleys, to which are attached harness cords having mail eye heddles. The pulleys rotate in order to pull the harness cords against pre-tensioned springs to displace the mail eye upwardly. This device is primarily directed to the inclusion of individual harness cord displacing means to individually control each pulley independently of other pulleys, and to selectively control the height or lift at which each mail eye is displaced. This machine, however, is useful only for narrow, intricate weaving operations and has no general application to high-speed, wide-loom weaving. Another drawback of the device disclosed in U.S. Pat. No. 4,440,196 is that, as in other prior art weaving looms, the harness cord is biased upwardly against the tension exerted by a cord tensioning system or spring. This device, however, has the additional disadvantage of requiring a spring for each, respective mail eye.

SUMMARY OF THE INVENTION

The present loom harness disclosed herein is adapted to be incorporated into a weaving loom. The principle objective of the loom harness is to translate or shift the warp yarn in order to create a shed through which the weft yarn is passed. The apparatus and method employed by the present invention to create the shed, however, have many advantages over the prior art. The other basic elements of a weaving loom into which this loom harness can be incorporated, including the yarn feed and fabric take up mechanisms, the weft yarn insertion system, and the dobby are well known in the art.

Briefly described, the present invention includes an upstanding, rigid, stationary frame, having upper and lower support plates integral thereto. The upper and lower support Plates, respectively, support rows of parallel, offset, cut-away cylinders. Various embodiments of these cylinders can be utilized, including sectionalized cylinders of approximately one-half the surface area of a cylinder, down to a series of sections of pulleys arranged on a reduced diameter torque tube. The cylinders, or torque tubes, are journalled by pillow blocks or bearing blocks securely mounted to the support plates. The bearing blocks are arranged along the support plate so that the torque tubes can be supported by as many supporting blocks as it is necessary to, inter alia. reduce deflection of the shafts, or transverse support beams of the heddle frames. The bearing blocks mounted to the upper support plate are arranged so that the uppermost rows of bearing blocks extend outwardly from the surface of the support plate a greater distance than the next succeeding row of bearing blocks. This insures that the axis of the respective torque tubes are parallel but offset with respect to one another. Conversely, the bearing blocks mounted to the lower support plate are arranged so that the lowermost bearing blocks project outwardly from the surface of the support plate a greater distance than the next succeeding upper bearing block, so that the torque tubes journalled therein are also parallel but offset.

When the reduced-diameter torque tubes are used, for example, adjacent to the bearing blocks and fixedly mounted to the torque tubes to turn therewith are arcuate members or pulleys. These pulleys are arranged along each respective torque tube of the upper plate so as to correspond to an identically located pulley rigidly mounted to its corresponding torque tube of the lower plate, as a mirror-image. Attached to the outer, circumferential surface of each upper pulley and extending downwardly to be mounted to the outer, circumferential surface of the corresponding lower pulley, are wire cables. Attached to these cables are lightweight heddle frames carrying vertically aligned heddles between the upper and lower rods attached to upper and lower shafts of the heddle frame. These lightweight frames can incorporate a flexible, tension-type center brace for additional, structural support.

The torque tubes of the upper and lower plates and their respective pulleys, connecting cables, and heddle frames are therefor grouped into pairs, or scrolls. A typical loom harness with the present invention will include four pairs of such scrolls nested together, mounted to the upper and lower plates of the stationary frame. The nested pairs are such that the uppermost and lowermost torque tubes form a first scroll, the next succeeding torque tubes of the upper and lower frame closer to the heddle eyes comprise a second scroll, and so on until the torque tubes of the upper and lower frames closest to heddle eyes form the fourth scroll. The cables or flexible elements are arranged in parallel, upright, transversely extending adjacent planes tangent to the pulley.

Rotational oscillation, or rocking, about a fixed center line or fixed axis of the torque tubes associated with the upper plate in a clockwise direction, causes their corresponding pulleys to oscillate clockwise thus taking up the cable, and moving or shifting the heddle frames upwardly. Conversely, counterclockwise oscillation of the torque tubes associated with the lower plate causes their corresponding pulleys to oscillate counterclockwise, taking up cable and shifting the associated heddle frames downwardly. In this manner the various torque tubes can be selectively oscillated a desired degree to raise or lower each heddle frame, and therefore each heddle eye to the height necessary to form a shed of the warp yarn. Importantly, the cables attached to the lightweight heddle frames, which control the deflection and stress of these frames, are maintained in tension through both the upward and downward movement of the heddle frames by establishing tension in the groups of pulleys associated with these cables.

Various means can be employed to oscillate the torque tubes, and to maintain tension in the pulleys and cables. One such means includes groups of control pulleys at the end portions of each torque tube. Control cables connect corresponding control pulleys so that moving one control cable upwardly will cause the associated group of torque tubes of both the upper and lower plates to oscillate in a clockwise direction, and by moving the other control cable downwardly will cause the associated group of torque tubes on both the upper and lower plates to oscillate in a counterclockwise direction. These control cables run over the outer circumferential surface of one group in a clockwise direction, and over the outer circumferential surface of the other group in a counterclockwise direction, in order to create tension in all cables of the system.

The control means for the cables can be a device such as a dobby, as is well known in the art. Another means for controlling the movement of the torque tubes includes individual, numerically controlled servo motors which through a crank mechanism drive the torque tubes mounted to the upper plate. The other end of the upper plate's torque tubes will be attached drive shafts and miter gear mechanisms to drive the corresponding torque tube of the lower plate in a like direction of rotation.

In another embodiment, multiple, vertically aligned string heddles having centrally disposed mail eyes are used instead of the lightweight heddle frames attached to cables. In still another embodiment, two loom harnesses as described above can be placed facing one another in order to form the shed using additional mail eyes or heddles carried by light-weight frames.

The present invention therefore obviates the necessity of having the large moving support frames, which are becoming the critical element in terms of economic and practical functionability of present, high speed weaving looms. The offset arrangement of the torque tubes, also allows for any necessary gauge or distance between juxtaposed heddle eyes or mail eyes to be accomplished. Further, the torque tubes can be supported along their lengths by any number of bearing blocks adjacent to the pulleys, additionally to support each pulley and associated cable, which control the deflection and stresses of the heddle frames.

Thus, the apparatus of present invention eliminates the heavy, highly-stressed moving support frames of present high speed looms, while being able to achieve a weaving rate presently accomplished by modern, high speed looms.

Accordingly, it is an object of the present invention to provide a loom harness which is efficient in operation, easily maintained, and durable in structure.

Another object of the present invention is to provide a loom harness which is capable of creating a shed of warp yarn at high weaving rates without the use of support frames.

Another object of the invention is to provide a loom harness which nests pairs of torque tubes, pulleys, cables and heddle frames or mail eyes in offset relationship in order to permit a gauge of very small dimension between the respective heddle frames or the mail eyes.

Another object of the present invention is to provide a loom harness wherein stresses and deflections resulting in the frames from the shedding operation are significantly reduced through the use of intermediate supports.

Another object of the present invention is to provide a loom harness which utilizes a rigid, stationary frame.

Another object of the present invention is to provide a loom harness which incorporates pairs of cut-away cylinders to control the shifting of the heddle frames or the mail eyes.

Another object of the present invention is to provide a loom harness which incorporates a rigid, non-moving support structure that provides simultaneous support for numerous rows of heddle frames or the mail eyes.

Another object of the present invention is to provide a loom harness having torque tubes for transmission of rotational torque to oscillate pulley members supported radially about the torque tube in fixed relationship thereto.

Another object of the present invention is to provide a loom harness in which the shifting of the heddle frames or the mail eyes is accomplished by an A-C servo (or other suitable) motor controlled by a computer software program.

Another object of the present invention is to provide a loom harness in which the shifting of the heddle frames or the mail eyes is controlled using a dobby.

Another object of the present invention is to provide a loom harness which can incorporate either mail eyes attached to flexible wire or using heddles carried by heddles frames.

Another object of the present invention is to provide a method for shedding or translating warp yarn in which both the upward and downward movement of heddles is controlled by cables in tension.

Another object of the present invention is to provide a method for shedding warp yarn in which the shed is created by the selective oscillation of groups of sectionalized cylinders, thus converting rotary motion of the cylinders to the linear (up or down) motion of the heddle eyes.

Other objects, features and advantages of the present invention will become apparent from the following description when taken in conjunction with the accompanying drawings, wherein like characters of reference designate corresponding parts through the several views

DESCRIPTION OF THE PREFERRED EMBODIMENTS

Figure 1:
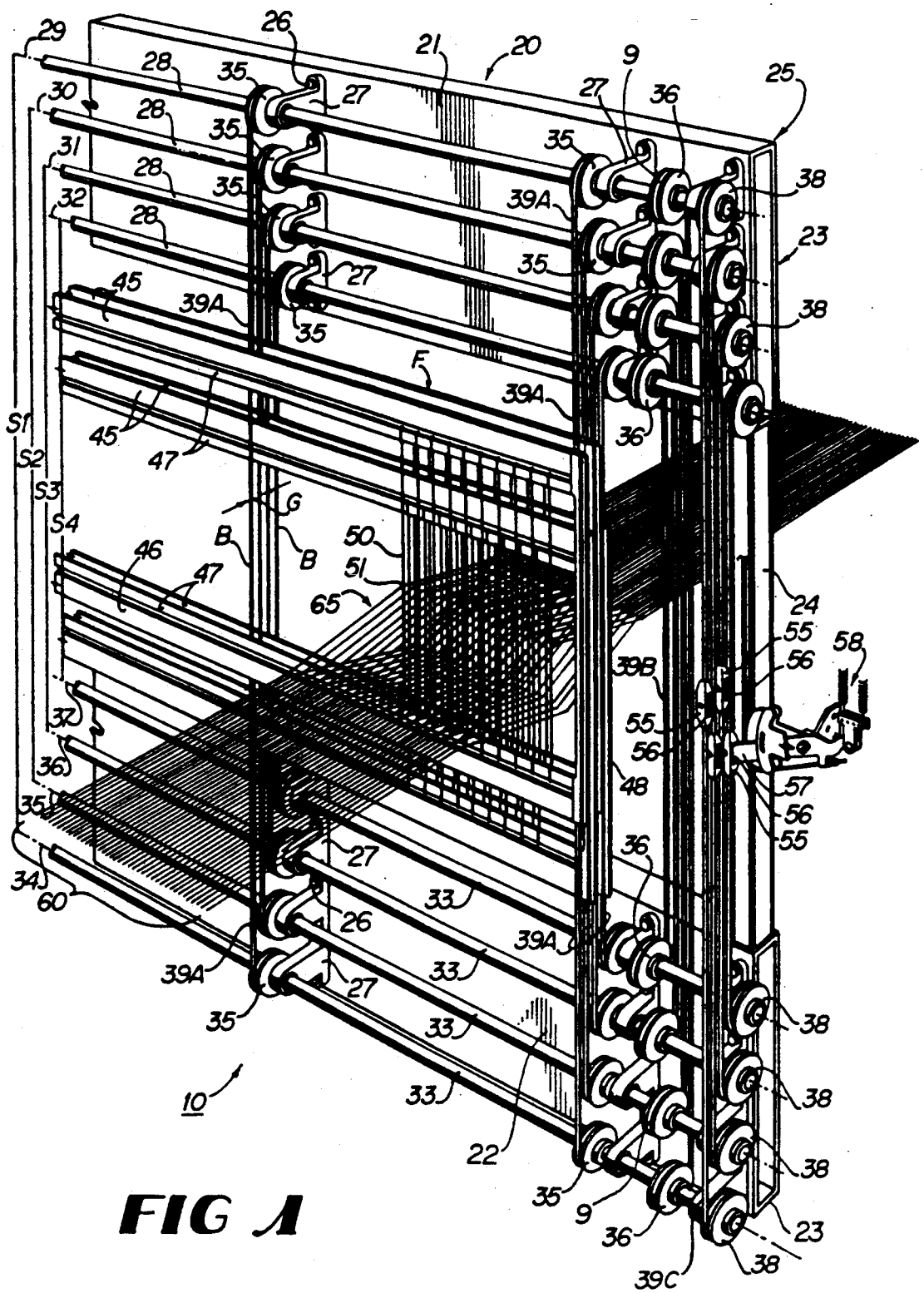
FIG. 1 is a perspective view of one embodiment of the loom harness of the present invention.
Figure 2:
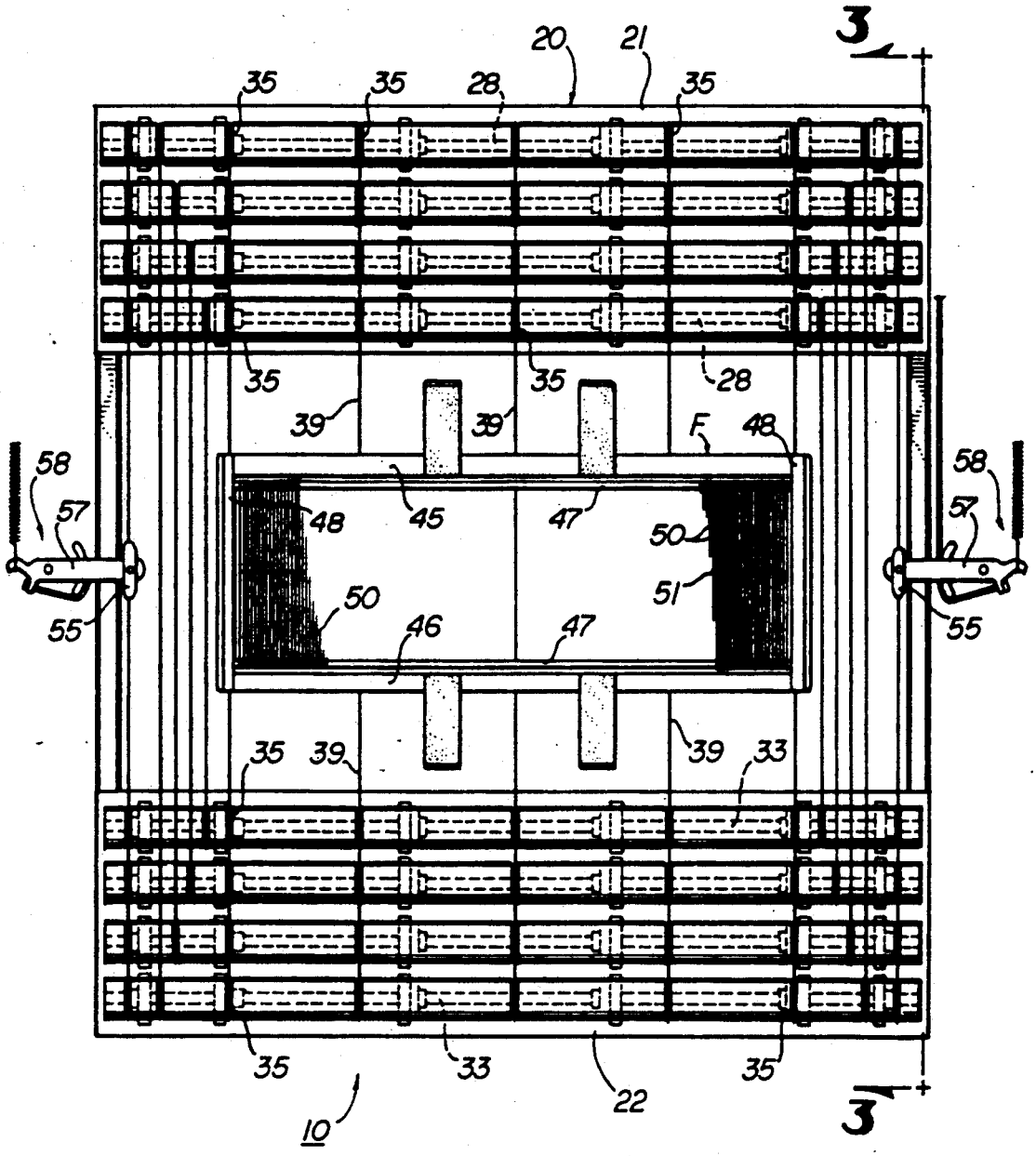
FIG. 2 is a front elevational view of the loom harness illustrated in FIG. 1.

Referring now to the embodiments herein chosen for the purpose Of describing the present invention, FIG. 1 illustrates loom harness 10 having an upright, rigid, stationary frame 20. Frame 20 includes elongate rectangular square upper plate 21 and an identical corresponding lower plate 22. Upper plate or beam 21 and lower plate or beam 22 are integrally connected at each end portion 23 by upstanding, vertical, rigid support members 24. FIG. 1 is a fragmentary perspective view of a section of a loom harness 10 and illustrates only the right side of loom harness 10 depicting one of the vertical support members 24 rigidly attached to plates 21 and 22. Upper plate 21, lower plate 22 and upstanding support members 24 therefore comprise rigid, non-moving support structure or stationary frame 20, which can be constructed of any suitable material such as steel, without regard to weight, since frame 20 remains stationary during the operation of harness 10.

Securely mounted to upper plate 21 and lower plate 22 by releasable mechanical fasteners 26 are pillow blocks or bearing blocks 27. As seen in FIG. 1, the respective columns of pillow blocks 27 of upper plate 21 are in vertical, columnar alignment with their corresponding pillow blocks 27 of lower plate 22. Other journalling means such as shaft hangers suitable for journalling a shaft can be alternatively used for pillow blocks 27. As seen in FIG. 1, pillow blocks 27 project from top plate 21 so that the uppermost row of pillow blocks 27 projects further from plate 21 than the next succeeding row of pillow blocks 27. Thus considering a single column of pillow blocks 27 of upper plate 21, the height, or distance that the pillow blocks 27 extend from plate 21, decreases or tapers inwardly toward upper plate 21, from the uppermost pillow block 27 to the lowermost pillow block 27 of upper frame 21. Conversely, the pillow blocks 27 in a vertical column arranged on lower plate 22 taper toward lower plate 22 in an upward direction. As shown in FIG. 1, the pillow blocks 27 of the various rows associated with either upper plate 21 or lower plate 22 are identical except for their heights.

FIG. 1 also shows four rows of pillow blocks 27 attached to both the upper plate 21 and to lower plate 22, respectively. Journalled in each row of pillow blocks 27 to turn freely therein are tubular, elongate, transversely extending torque tubes or shafts 28. The shafts 28 journalled by pillow blocks 27 to upper plate 21 include axes 29, 30, 31 and 32, respectively. Since the heights of the pillow blocks 27 of upper plate 21 decrease in descending order per row of pillow blocks 27, axis 29 is spaced a distance further from upper plate 21 than axis 30. Axis 30 is, in turn, spaced a distance further away from upper plate 21 than axis 31, which is likewise spaced from plate 21 further than that of axis 32.

Similarly, pillow blocks 27 mounted to lower plate 22 freely journal tubular, elongate, transversely extending torque tubes or shafts 33 having axes 34, 35, 36 and 37, respectively. Axis 34 is spaced a greater distance from lower plate 22 than axis 35, which s spaced a greater distance from plate 22 than axis 36. Axis 36 is likewise spaced from plate 22 a greater distance than axis 37. The spacing of these respective axes of upper shafts 28 and lower shafts 33 from one another, or from beam 21 or 22, can readily be adjusted by varying the heights of the respective pillow blocks 27 journalling shafts 28 or 33.

Securely mounted to upper shafts 28 and to lower shafts 33 to oscillate therewith are arcuate members or pulleys 35. Pulleys 35 preferably are mounted to shafts 28 and 33, respectively, adjacent to bearing blocks 27 for the required support. Each shaft 28 and 33 includes pulleys 35 mounted thereto adjacent to a pillow block 27 and arranged in vertically aligned columns, as shown in FIG. 1. Each shaft 28 and 33 also includes additional pulleys vertically aligned in two separate columns, and mounted to shafts 28 and 33 near their end portions. The additional pulleys in the inner columns are each denoted as control pulleys 36, and the additional pulleys in the outer columns are denoted as control pulleys 38. The purpose of control pulleys 36 and 38 is slightly different from that of pulleys 35, as described further herein. Pulleys 35, 36, and 37 each define along their outer circumferential service, annular channels or grooves 9.

Elongate, flexible wire cables 39A are securely attached at one end to pulleys 35 of shaft 28 so that cables 39A wrap around the outer circumference of pulleys 35 within channels 9, when shafts 28 are oscillated in a clockwise direction when viewed from the right hand side of FIG. 1. Similary, elongate, flexible wire cables 39C are securely attached at one end to pulleys 38 of shaft 28, so that cables 39C wrap around the outer circumference of pulleys 38 within channels 9 when shafts 28 are oscillated in a clockwise direction. Conversely, however, elongate, flexible wire cables 39D are securely attached at one end to pulleys 36 of shaft 28 so that cables 39B wrap around the outer circumference of pulleys 36 within channels 9, when shafts 28 are oscillated in a counterclockwise direction. Cables 39A extend downwardly from their associated pulleys 35 of shafts 28 and are securely attached to the outer circumference of pulleys 35 of shafts 33 in their respective columns, so that cables 39A wrap around pulleys 35 of shafts 33 within grooves 9 when shafts 23 are rotated in a counterclockwise direction. Similarly, cables 39C stand downwardly from their associated pulleys 38 of shafts 28 and are securely attached to the outer circumference of pulleys 38 of shafts 33 in their respective columns, so that cables 39C wrap around pulleys 38 of shafts 33 within grooves 9 when shafts 3*e* are rotated in a counterclockwise direction. Conversely, however, cables 39B extend downwardly from their associated pulleys 36 of shafts 28 are securely attached to the outer circumference of pulleys 36 of shafts 33 in their respective columns, so that cables 39*b* wrap around pulleys 36 of shafts 33 within grooves 9, when shafts 33 are rotated in a clockwise direction.

As shown in FIG. 1, considering a vertically aligned column of pulleys 35 a cable 39A connects the uppermost pulley 35 along axis 29 to the lowermost, vertically aligned pulley 35 of axis 34. Other cables 39A connect the pulleys 35 along axis 30 to the pulleys 35 along axis 35. A third set of cables 39A connects the pulleys 35 along axis 31 to pulleys 35 along axis 36. And finally, a fourth set of cables 39A connects pulleys 35 along axis 32 to pulleys 35 along axis 37. Cables 39B and 39C connect their appropriate, respective pulleys 36 and 38 along these axes in similar fashion. Thus the rows of pulleys 35 and shaft 28 along axis 29, together with the row of pulleys 35 and shaft 33 along axis 34, and their connecting cables 39A, are considered to comprise an associate group or first scroll S1. Likewise, the pulleys 35 and shaft 28 along axis 30 and the pulleys 35 and shaft 33 along axis 35 and their connecting cables 39 are considered a second scroll S2. A third scroll S3 is comprised of the pulleys along axes 31 and 36, their associated shafts 28 and 33 and their connecting cables 39, and a fourth scroll S4 is comprised of pulleys 35 along axes 32 and 37 and their connecting cables 39. These four associated groups of scrolls S1 through S4 are nested together onto frame 20.

The nesting of scrolls S1 through S4 is accomplished because of the decreased heights of pillow blocks 27 as described above. When scrolls S1 through S4 are nested in this manner, a distance or gauge G exists between juxtaposed cables 39A. This gauge G can be readily adjusted by varying the heights of the respective pillow blocks 27 of scrolls S1 through S4.

Securely mounted to cables 39A extending from pulleys 35 are elongate, transversely extending, flat, upper heddle shafts 45. Spaced below heddle rods 45 are identical, flat, tranversely extending lower heddle shafts 46. Rivited to heddle shafts 45 and 46 are longitudinally extending heddle rods 47. Heddle shafts 45 and 46 are securely mounted, by any suitable means such as releasable brackets (not shown), to each cable 39A. For example, cable 39A of scroll S1 will be securely mounted to one upper heddle shaft 45 and, spaced therefrom, to one lower heddle shaft 46. Similarly, cables 39A of scrolls S2, S3 and S4 also include attached thereto upper heddle shafts 45 and lower heddle shafts 46. Heddle shafts 45 and 46 mounted to their associate cables 39 of scrolls S1 through S4 are all spaced apart vertically the same distance, so as to be capable of being oriented in exact horizontal, planar alignment. The heddle shafts 45 and 46 are mounted to and extend from the cable 39A attached to the column of vertically aligned pulleys 35 furthest to the right of plates 21 and 22 and also to the cables 39A connected to the column of vertically aligned pulleys 35 which are furthest to the left of plates 21 and 22.

Figures 4, 5:
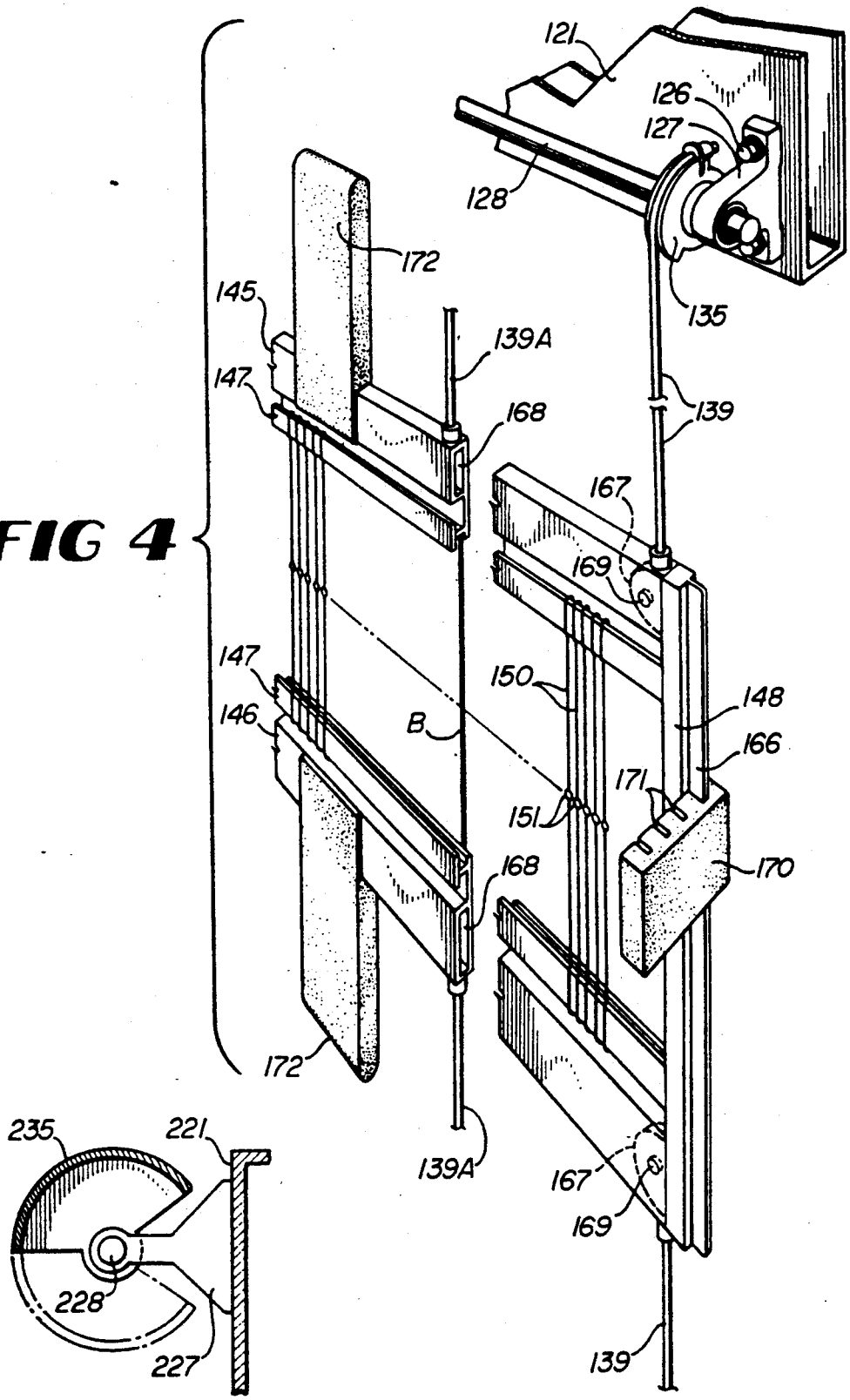
FIG. 4 is a fragmented, perspective view of the loom harness illustrated in FIG. 1, including a tension-type center brace and cross-sectional view of a guide block.
FIG. 5 is a schematized illustrated side elevational view of a sectionalized cylinder and a stationary support, having a ball bearing, thus allowing free rotation.

Vertically extending, elongate end pieces 48 connect upper heddle shafts 45 to their associated lower heddle shafts 46 for stability and guide purposes during operation, as is hereinafter discussed. The assembly of heddle shafts 45 and 46 to their associated end pieces 48 is considered a compact or lightweight heddle or support frame F. Received in slideable engagement over heddle rods 47 as shown in FIGS. 1 and 4, are flat, elongate, vertically extending heddles 50. Heddles 50 include centrally disposed eyelets 51 integral thereto, as is well known in the art. FIG. 1 shows a small group of heddles 50 arranged equidistantly spaced between the heddle rods 47 of upper heddle shafts 45 and heddle rods 47 of lower heddle shafts 46 of their associated scrolls. As is also well known in the art, a fully operable loom harness 10 can include heddles arranged over the entire lengths of the heddle rods 47. The heddle or support frame F thus defines a weaving area encompassed within the perimeter defined by associated rods 47 and their respective end pieces 48. For added structural integrity of heddle frame F, a flexible, tension-type center brace B can be centrally mounted between upper shaft 45 and lower shaft 46. If such a center brace B is used, the cable 39A above and below brace B, is securely fixed to shafts 45 and 46, respectively with any suitable attachment means (not shown).

Control pulleys 36 and 38 are also associated with shafts 28 or 33, respectively, and are included in each of scrolls S1 through S4. Control pulleys 36 are arranged in vertical alignment near the end portions of shafts 28 and 33 as shown in FIG. 1. Cables 39B connect control pulleys 36 of their respective scrolls. For example, cable 39B connects control pulley 36 arranged along axis 29 to control pulley 36 arranged along axis 34 of scroll S1. Cables 39B connect their respective control pulleys 36 identically with respect to scrolls S2, S3, and S4. Importantly, cables 39B are attached to control pulleys 36 of shafts 28 so as to wrap around the circumference of pulleys 36 of shafts 28 within grooves 9 when shafts 28 are oscillated in a counterclockwise direction. Conversely, cables 39B will wrap around the circumference of pulleys 36 mounted to shafts 33 of lower plate 22, when shafts 33 are oscillated in a counterclockwise direction. This is an important control feature of this embodiment of loom harness 10. Control pulleys 38 are spaced from pulleys 36 and mounted at the end portions of shafts 28 and 33, and are similarly connected by cables 39C as discussed with respect to control pulleys 36. However, an important distinction between the attachment of cables 39B to pulleys 36 and cables 39C to pulleys 38, is that cables 39C are attached to pulleys 38 of shafts 28 so as to wrap around the circumference of pulleys 38 when shafts 28 are rotated in a clockwise direction. Conversely, cables 39C will wrap around the circumference of pulleys 38 of shafts 33 of lower plate 22 when shafts 33 are oscillated in a counterclockwise direction. This is also an important control feature of this embodiment of loom harness 10. The cables 39A, 39B or 39C attached to their appropriate pulleys 35, 36, and 38, respectively, can be pretensioned, flexible wire cables, or can include a tensioning means such as a turnbuckle (not shown) in order to take up any slack caused by the stretching of cables 39. Further cables 39A are held in tension by tightening or the tension of cables 39B.

Securely attached to cables 39C of pulleys 38 are elongate actuating brackets 55 defining vertically extending channels 56 therein. Channels 56 receive therein crank arms 57 of dobby mechanisms 58 shown in schematized form. Dobby mechanisms such as dobby mechanisms 58 are well known in the art and can be selectively programmed to control the upward and downward movement of cables 39C. Any well known dobby mechanism can be adapted for use with the loom harness 10.

Figure 3:
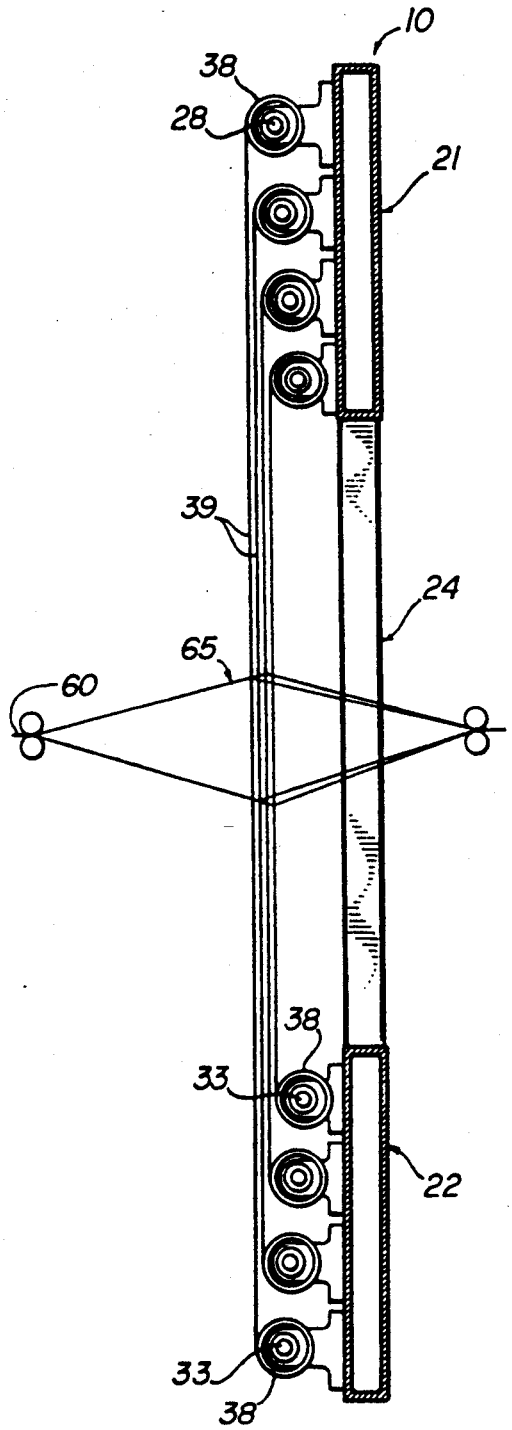
FIG. 3 is a side elevational view of the loom harness illustrated in FIG. 1.
Figure 3A:
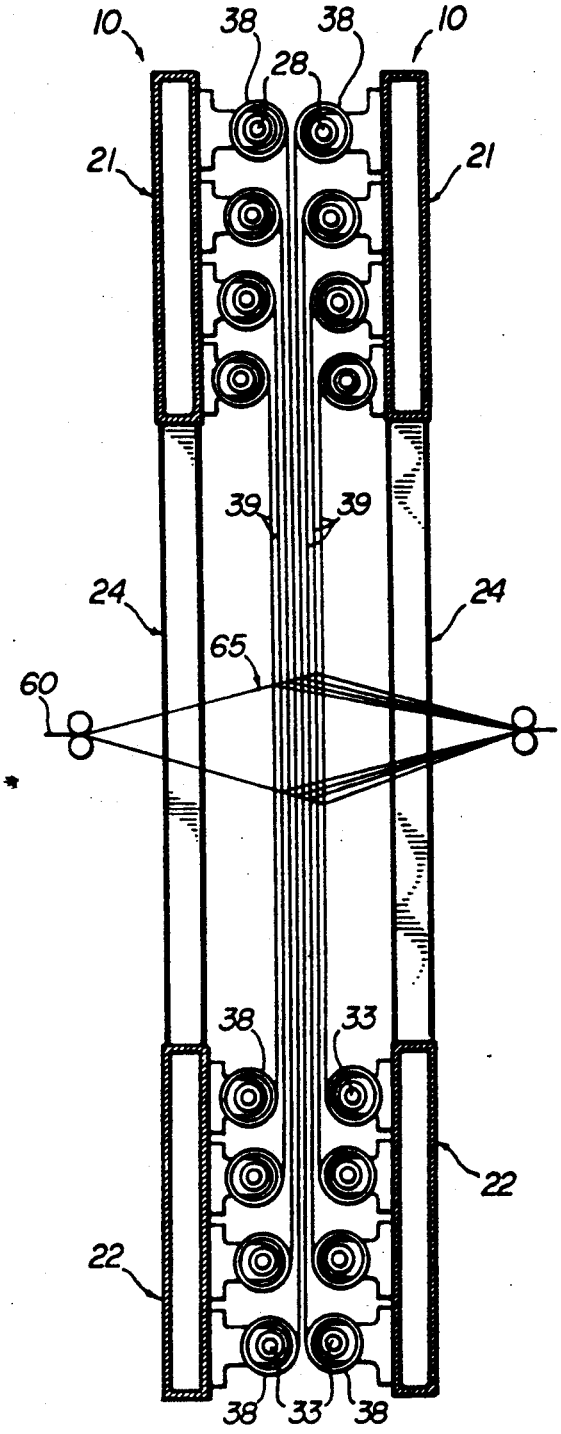
FIG. 3A is a side elevational view of the loom harness illustrated in FIG. 1, facing an identical, opposing loom harness.

As shown in FIGS. 1, 3 and 3A, strands of warp yarn, denoted collectively as numeral 60 are passed through eyes or eyelets 51 of heddles 50, one strand being passed through each eye 51.

The loom harness 10 of the present invention is adapted to be incorporated into a standard high speed weaving loom in place of the typical loom harness which incorporates large moving support frames. The loom harness 10 ultimately accomplishes the same purpose as the moving support frame loom-harness of present looms, that is, to create a shed. The loom harness 10 can be mounted in place of the standard, moving frame loom harness by mounting means well known in the art and not further described herein. Further, the remaining elements of the high speed weaving loom, such as the mechanism for delivering the weft yarn through the shed, the reed and the fabric takeup mechanisms are all part of the standard high speed weaving loom and not part of the present invention, and thus not further described herein.

In operation, the yarn strands 60 pass through eyelets or eyes 51 of heddles 50. Initially at rest, all eyelets 51 are in the same horizontal plane and all strands of warp yarn 60 are also parallel and in the same horizontal plane. The dobbys 58 which are attached to each of the brackets 55 of cables 39C of control pulleys 38 are preprogrammed to shift cables 39C of control pulleys 38 either vertically upward or downward. The selection of which cables 39C are shifted upward or downward, depends upon the program selected for the dobby mechanisms 58, and can be of any desired sequence. For example, when crank arm 57 of dobby 58 moves downwardly, pulling cable 39C of control pulley 38 downwardly, shaft 28 is rotated in a counterclockwise direction. Therefore, cable 39B attached to pulleys 36 are wrapped in a counterclockwise manner around pulleys 36 of shafts 28. Therefore, the cables 39B attached to pulleys 36 of shaft 28 are pulled upwardly. Because the lower ends of cables 39B of pulleys 36 are attached to the lower pulleys 36 of shafts 33, the upward movement of these cables 39B causes shafts 33 to be also oscillated in a counterclockwise direction. The counterclockwise direction of shafts 33 causes pulleys 35 of shafts 33 to oscillate or rock counterclockwise, thus taking up cable 39A of pulleys 35, and thus pulling in tension cables 39A of pulleys 35 downwardly. This downward movement of cables 39A also pulls downwardly, heddle frames F and heddles 50 which are engaged to heddle rods 45 and 46. Thus, the warp yarn passing through eyes 51 are pulled downwardly.

Conversely, if crank arm 57 is shifted upwardly, cables 39C of control pulleys 38 cause control pulleys 38 of lower shafts 33 to oscillate clockwise, causing shaft 33 to oscillate clockwise. The clockwise oscillation of shaft 33 causes control pulleys 36 of shaft 33 also to oscillate clockwise, thus taking up, and therefore pulling downwardly, cables 39B attached to control pulley 36. This causes the clockwise oscillation of control pulleys 36 of upper shafts 28 which, in turn, causes the clockwise oscillation of upper shafts 28. As upper shafts 28 oscillate clockwise, pulleys 35 of upper shafts 28 also oscillate clockwise, taking up or pulling upwardly in tension their associated cables 39A. This upward movement of cables 39A pulls heddle frame F and heddles 50 upwardly also, thus shifting eyes 51 of heddles 50 upward. It is thus obvious that by shifting control cables 39C of pulleys 38 either upwardly or downwardly, the rows of eyes 51 are also shifted upwardly or downwardly. As is obvious to those skilled in the art, various cables 39C of control pulleys 38 can be alternately shifted upwardly and downwardly, simultaneously, to shift some eyes 51 upwardly and some eyes 51 downwardly. When this action takes place, a shed 65 is created in the strands of the warp yarn 60. Thus, the shedding occurs without the necessity of shifting large, movable support frames, as occurs in todays high speed weaving looms. The oscillation of the shafts will normally be through a rotation of less than approximately one hundred forty degrees.

If the fabric being woven requires the positioning of more rows of eyes in shed 65, two loom harnesses 10 can be arranged facing one another as depicted in FIG. 3A. This allows additional heddles 50 to be utilized to create the desired shed 65.

FIG. 4 shows alternate embodiments of various features of the first embodiment described above. In FIG. 4 the pillow blocks 127 are identical to pillow blocks 327, however, the pulleys 135 are not completely annular but are arcuate portions of an annular pulley. An arcuate pulley 135 instead of a round pulley 35 can be utilized, since the oscillation of shaft 128 and pulley 135 normally is through an angle typically less than ½ of a revolution, that is, less than one hundred eighty degrees, and as referenced above is normally less than approximately one hundred forty degrees. FIG. 4 also shows an alternate attachment of cables 139A to upper heddle shafts 145 and to lower heddle shafts 146. Instead of cable 139A running continuously from pulley 135 of uppershaft 128 down to and attaching to pulley 135 of lower shaft 133 (not shown), cables 139A, extending downwardly from pulley 135 of upper shaft 128 are attached at their lower ends to upper heddle shaft 145 by any attachment means well known in the art. Similarly, cables 139A extending upwardly from pulleys 135 on lower shafts 133 (not shown) are attached to lower heddle shaft 146 as shown in FIG. 4.

The width of end piece 148 is decreased along its outer vertical edge to form elongate flat flange 166 projecting outwardly therefrom. At the upper and lower, inner sides of end piece 148 projects flat, plate-like, arcuate bracket 167 which is received in transversely extending channel 168 defined in upper heddle shaft 145 and lower heddle shaft 146. A pin (not shown) passes through hole 169 of flange 167 to attach end pieces 148 to heddle rods 145 and 146. This arrangement, therefore, allows for a slight flexing of heddle shafts 145 and 146 with respect to end pieces 48.

FIG. 4 also shows guide block 170 which is made of a low friction material such as nylon and which define elongate grooves or channels 171 therein, which receives flange 166 of end piece 148. Such guide blocks are well known in the art and function to maintain end pieces 148 in the correct vertical plane. Attached to both upper heddle shaft 145 and lower heddle shaft 146 are nose guides 172 which also function to keep the respective heddle shafts 145 and 146 in the appropriate vertical plane. A flexible, elongate, tension-type center brace B can be attached to upper heddle shaft 145 and lower heddle shaft 146 for the continuity of suspension means.

The alternate embodiments of the elements discussed above can individually be incorporated into the first embodiment described herein, as desired.

Various arrangements other than the round pulley 35 and the arcuate pulleys 135 can be employed to pull cables 139A upwardly and downwardly. The pulleys 35 and 135 can be considered sectionalized cylinders, cut away so that only a portion or section of the cylinder remains. As shown schematically in FIG. 6, various portions of a cylinder with its axis about shaft 228 or shaft 233 (not shown) can be utilized to provide simultaneous support for several rows of eyes or heddles.

Figure 6:
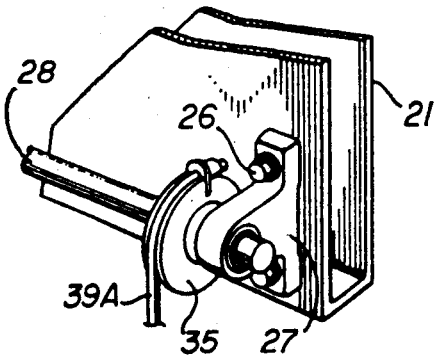
FIG. 6 is an enlarged perspective view, partly in cross-section, of a round pulley of the loom harness illustrated in FIG. 1.
Figure 7:
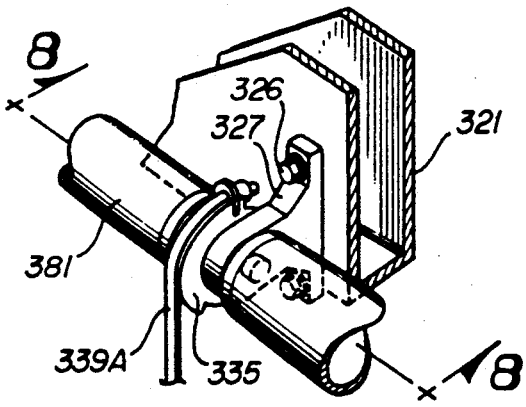
FIG. 7 is an enlarged, perspective view, partly in cross-section, of a segmented torque tube and pulley arrangement of the present invention.
Figure 8:
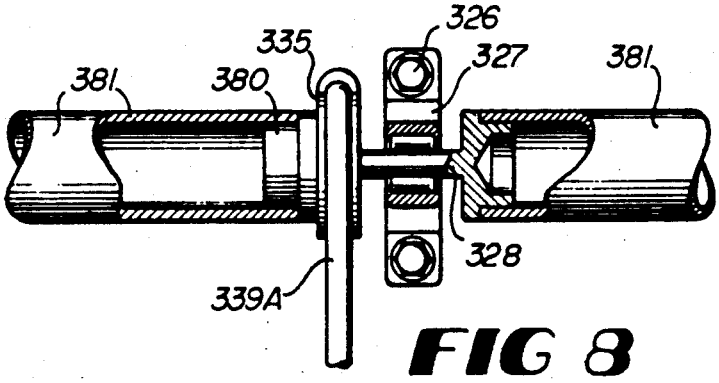
FIG. 8 is an elevated front view partially in cross-section of the torque tube and pulley illustrated in FIG. 7.

Examples of various means for shifting cables carrying heddles or eyes upwardly or downwardly, are shown in FIGS. 6–10. FIG. 6 depicts a round pulley 35 mounted to a shaft 28 of reduced diameter as described with respect to FIG. 1. FIG. 7 shows an alternate embodiment of a lifting means in which a arcuate or partial pulley 335 is mounted to a reduced diameter shaft 328. This shaft is journalled and supported by bearing block 327. Shaft 328, however, does not extend to the next, juxtaposed pulley 335, but is instead integrally connected to spool 380 which is connected to the interior of elongate, tubular, cylinder 381. Cylinder 381 extends to the next juxtaposed support 327 where it connects to another spool 80 and reduced diameter shaft 328 and pulley 335, identically as discussed above.

Figure 9:
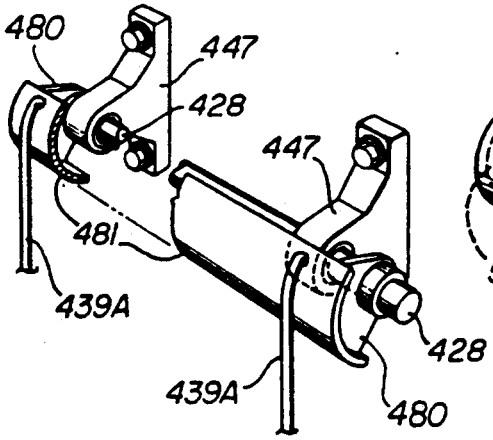
FIG. 9 is another embodiment of a segmented torque tube of the present invention.
Figure 10:
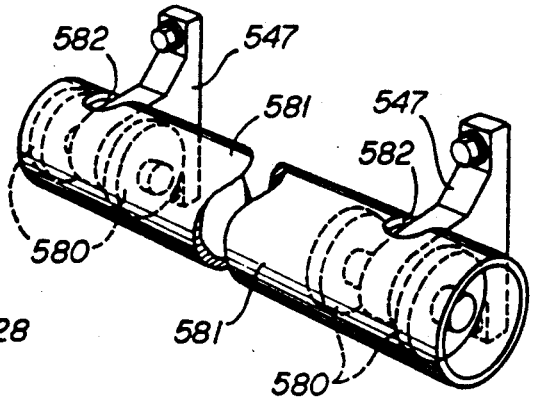
FIG. 10 is a full cylindrical torque tube of the present invention showing interface with stationary supports.

FIG. 9 depicts yet another arrangement for the lifting means, which eliminates the round or arcuate pulleys altogether, and instead employs another sectionalized cylinder arrangement. Pillow blocks 447 journal horizontally or transversely extending torque tubes or shafts 428 which are securely mounted to spools 480. Sectionalized cylinder 481 is attached to spools 480 and so rotates with shaft 428. FIG. 10 shows an entire cylinder 581 with cutaway slots 582 therein to allow for the insertion of the journalling portion of pillow blocks 547. Thus, a substantially entire cylinder 581 can be employed. This concept also allows the cylinders or portions of cylinders or pulleys to be supported at as many positions along their length as is required to reduce their deflection to within acceptable limit, but more importantly to provide support for the downwardly extending cables which support the heddle frames or string heddles (not shown), as appropriate. No matter which lifting means is employed, it is to be understood that each means is essentially a cylinder or sectionalized cylinder, as discussed above.

Figure 11:
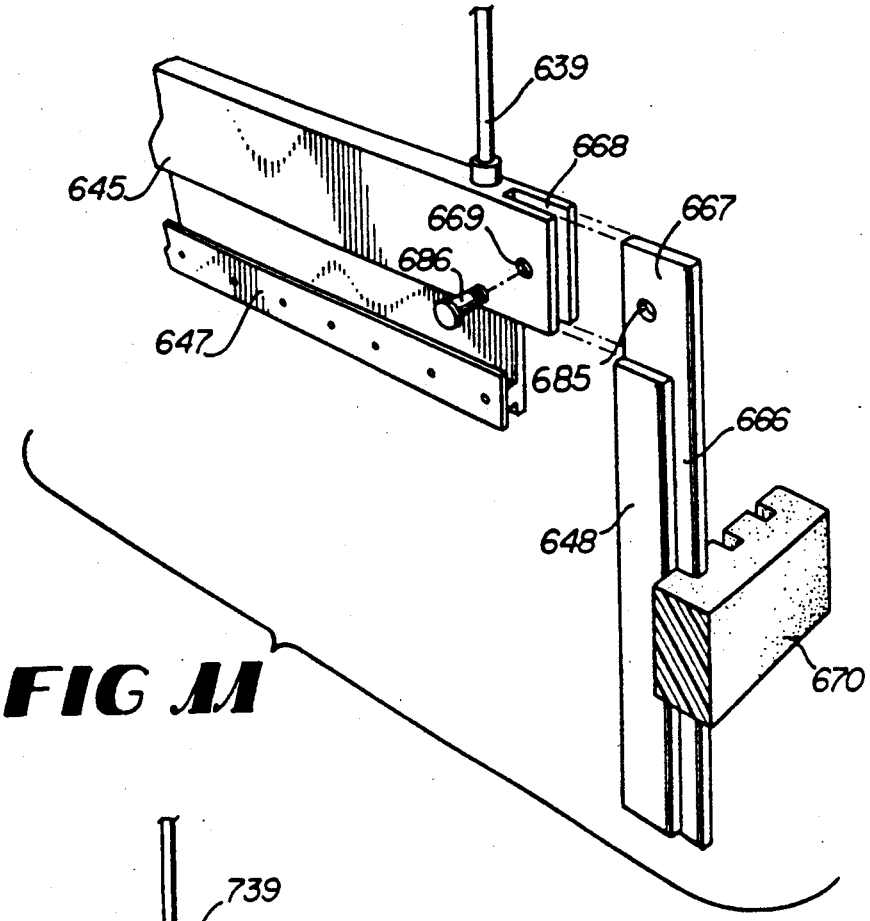
FIG. 11 is an exploded, perspective view, partly in cross-section of a portion of one embodiment of a lightweight heddle frame of the present invention.

FIG. 11 depicts a heddle rod which can be used alternatively to the alternate embodiment of the heddle shafts 45 and 46 and heddle rods 47 and end piece of FIG. 1. Heddle rod 645 defines a vertically extending channel 668 at each end of heddle rod 645. End piece 648 defines a flat end portion 667 which is of a reduced width that approximates the width of vertical channel 668 to fit therein. End piece 645 also defines aperture 669 therethrough, which aligns with aperture 685 defined in end piece 648 when flange 667 is inserted into channel 668. Pin 686 passes through apertures 669 and 685 to secure heddle rod 645 and end piece 648, allowing slight Pivotal movement there-between. Longitudinal channel 647, vertically extending flange 666 and guide block 670 perform the identical functions to the corresponding elements described with reference to the prior embodiments.

Figure 12:
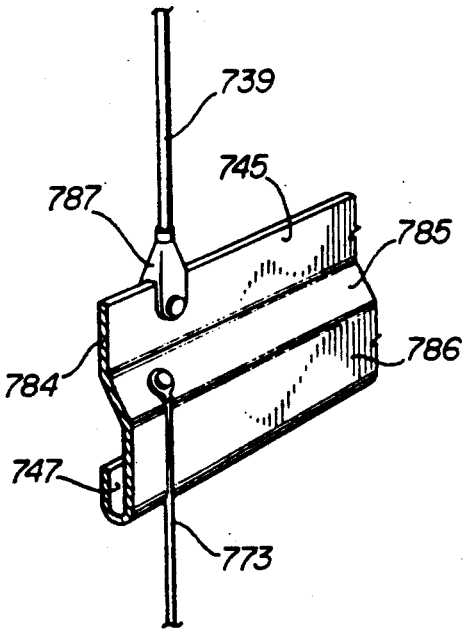
FIG. 12 is a fragmentary, perspective view of a heddle rod of the present invention, showing attachment of a tension-type center brace.
Figure 12A:
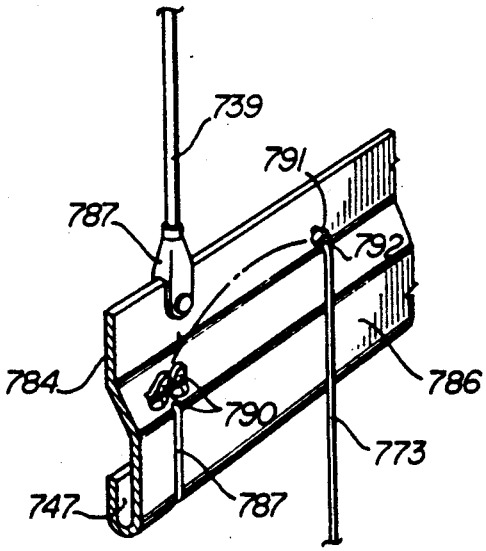
FIG. 12A is a fragmentary, perspective view of the heddle road illustrated in FIG. 12, showing an alternate attachment of a tension-type center brace.

FIG. 12 illustrates an alternate embodiment for the heddle rod and its associated elements used without a shaft. Heddle rod 745 is "J"-shaped, having upper, vertically extending, flat portion 784, outwardly angled transition portion 785 and inwardly curving "U"-shaped portion 786, defining longitudinal channel 747 therein. Attached to the lower end portion of cable 739 is clevis 787 which receives upper flange 784 of heddle rod 745. Attached to transition portion 785 of heddle rod 745 is center brace 773. As shown in FIG. 12-A, "U"-shaped portion 786 of heddle rod 745 can define therein along its outer side, vertically extending channel 787 to receive center brace 773 therein. Any suitable attachment means, such as pins or rivets, can be use for the attachment of clevis 787 or center brace 773. An alternative anchoring means for center brace 773 includes upwardly extending, spaced tabs 790 stamped in transition portion 785. A swaged fitting or abutment means 791 attached to the end portions 792 of brace 773 is received between and abuts tabs 790 to hold center brace 773 in tension.

Figure 13:
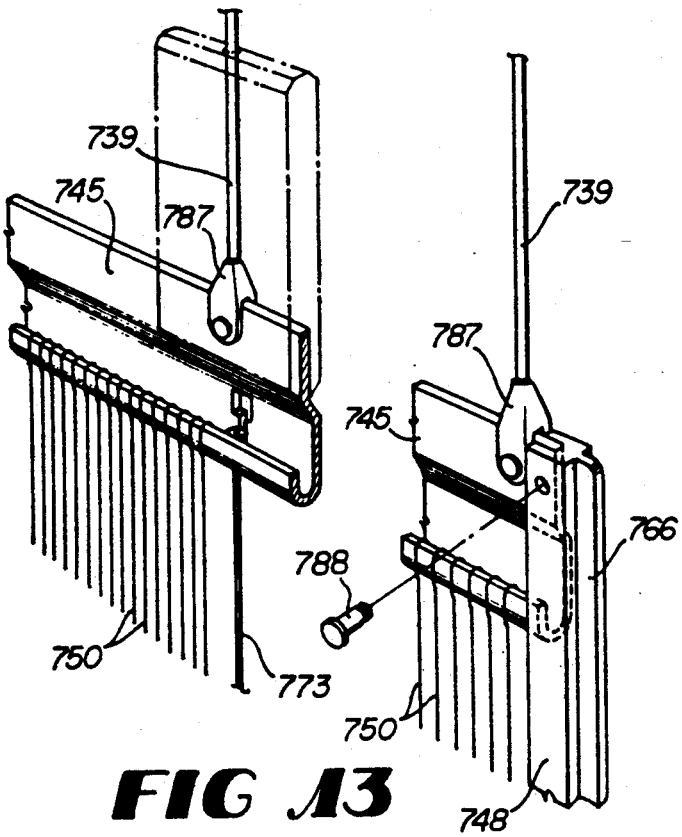
FIG. 13 is a fragmentary, perspective view of one embodiment of the heddle rod of the present invention, wherein the heddle rod and shaft are one integral piece.

FIG. 13 shows heddles 750 arranged along heddle rod 745. Heddle rod 745 is supported by cable 739 and attached to clevis 787. Flexible, tension-type center brace 773 is attached to the outer portion of heddle rod 747, and end piece 748 is attached to the end portion of heddle rod 745 with pin 788.

Figure 14:
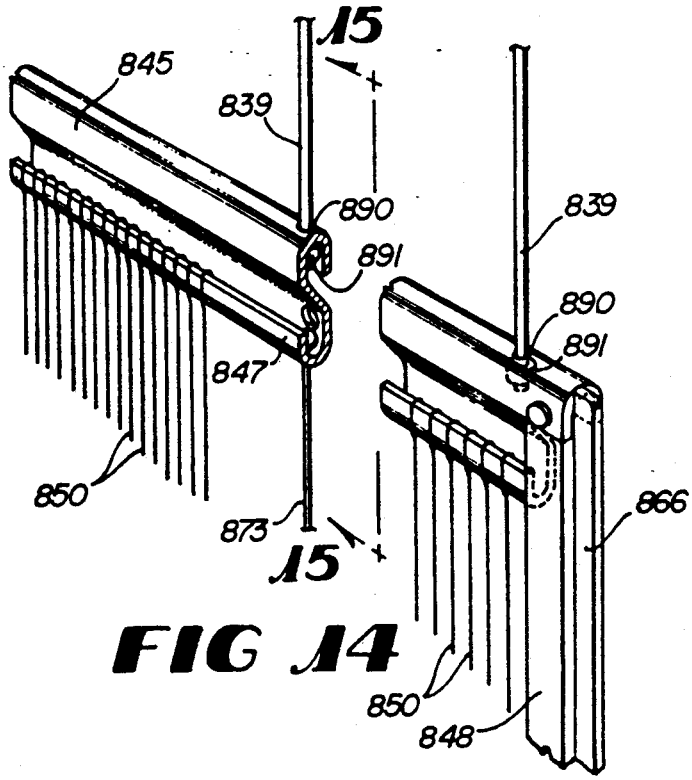
FIG. 14 is a fragmentary perspective view of another embodiment of the heddle frame of the present invention.

FIG. 14 illustrates an "S"-shaped heddle rod 845 which defines along its upper, rounded portion aperture 890. Cable 839 extends through aperture 890 and is attached to boss 891 for support. Similarly, center brace 873 is attached through the bottom rounded portion of heddle 845 as shown in FIGS. 14 and 15.

Figure 15:
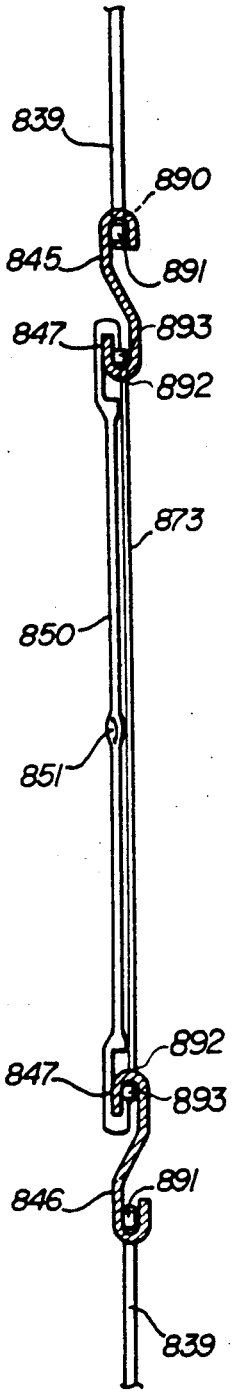
FIG. 15 is a cross-sectional view of the embodiment of the heddle frame illustrated in FIG. 14.

FIG. 15 shows in cross-section the arrangement partly depicted in FIG. 14, with both upper heddle rod 845 and lower heddle rod 846. Heddles 850 slidably engage channels 847 of upper and lower heddle rods respectively. Tabs 892 are stamped into heddle rod 845 and receive therebetween swaged fitting 893 or brace 873.

Figure 16:
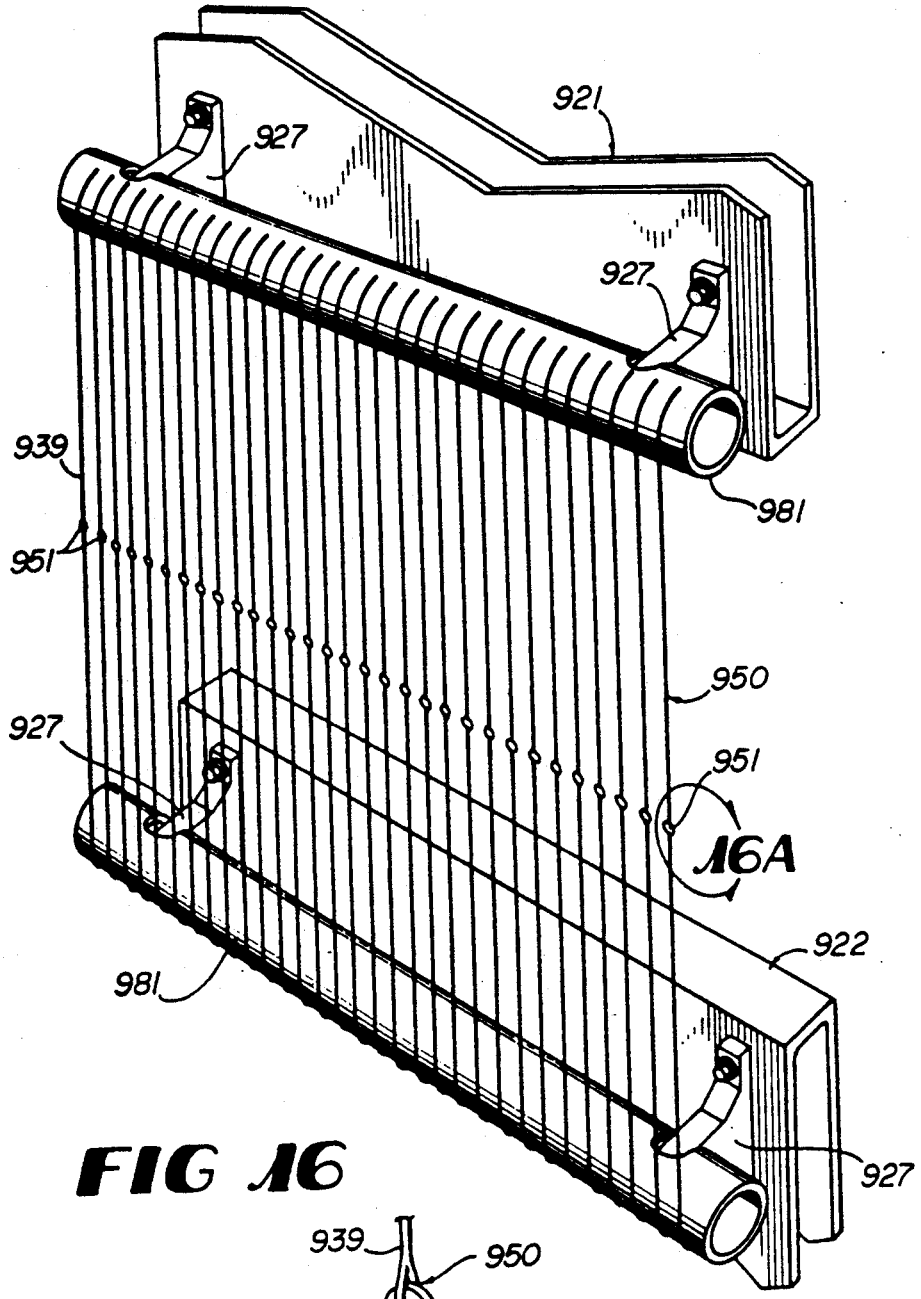
FIG. 16 is another embodiment of the loom harness of the present invention, having string or wire heddles.
Figure 16A:
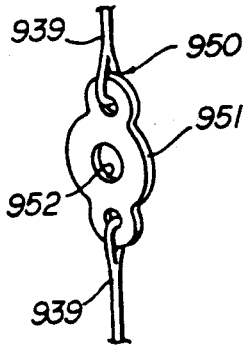
FIG. 16A is an insert view of the mail eye of the embodiment illustrated in FIG. 16.

FIG. 16 illustrates another embodiment of the presient invention in which string heddles 950 having mail eyes 951 are suspended between cables 939. This embodiment eliminates the use of heddle frames and heddles, as described above. An elongate, transversely extending, tubular cylinder 981 is supported by pillow blocks 927 as described with reference to the embodiment depicted in FIG. 10. The mail eye 950 of string heddle 951 is shown enlarged in FIG. 16-A, lace of the mail eyes 951 by the frames F being supported by cables 939, as frames F are supported by cables 39 in FIG. 1. Similarly, the mail eyes 951 of FIG. 16 can be incorporated into the cables 39 and 39A of the embodiment shown in FIG. 1 instead of frames F. In this case, numerous additional cables 39 and 39A are attached to pulleys 35 of upper shafts 28 and to pulleys 35 of lower shafts 33.

Figure 17:
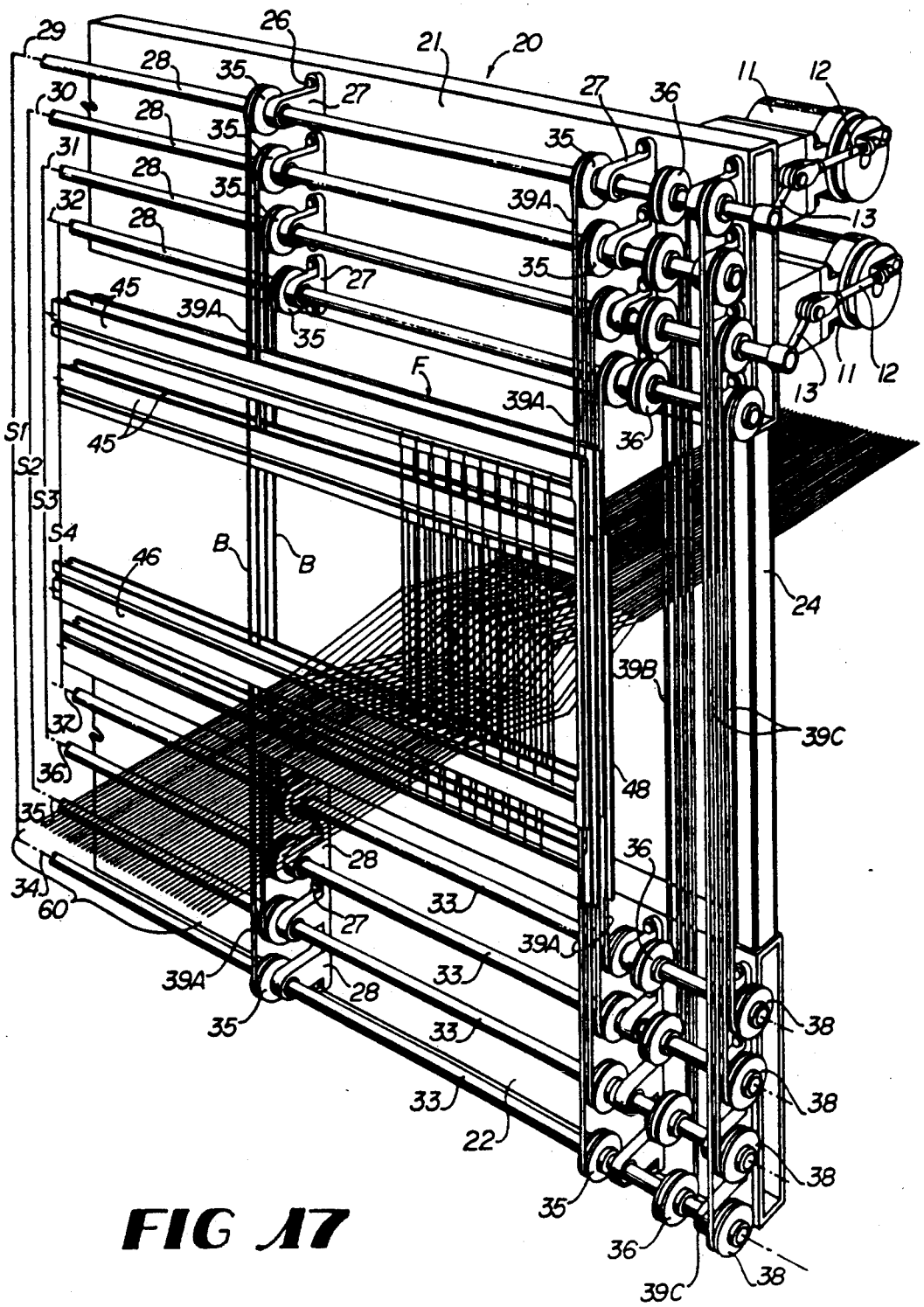
FIG. 17 is a perspective view of another embodiment of the present invention.

FIG. 17 shows an alternative means for controlling the upward and downward movement of cables 39A, 39B and 39C, using a crank-type mechanism. Instead of using a dobby mechanism 58, an A-C servo (or other suitable) motor can be used to oscillate shafts 28, which in turn causes oscillation of shafts 33 through cables 39B attached to control pulleys 36. Servo motor 11 is mechanically linked to shafts 28 through linkage 12 and 13. The operation of servo motor 11 thus will oscillate shafts 28 through the desired angle of rotation to shift cables 39A of pulleys 35 upwardly or downwardly as desired. When motors 11 oscillate shafts 28 in a counterclockwise direction, control pulleys 36 are oscillated counterclockwise, taking up or pulling their associated cables 39B, which causes shafts 33 to oscillate counterclockwise. This oscillation of shafts 33 turns pulleys 35 of shafts 33 counterclockwise, pulling in tension, heddle frames F downwardly. Conversely, when motor 11 causes shaft 28 to oscillate clockwise, pulleys 35 of shafts 28 also oscillate clockwise, pulling in tension heddle frames F upwardly. Therefore, although control pulleys 38 and their associated cables 39C are shown in FIG. 17, control pulleys 38 and their associated cables 39C can be eliminated when A-C servo motors are used, as in this embodiment. Although only 2 servo motors 11 are depicted in FIG. 17, each shaft 28 will be linked to a separate servo motor 11 to control the oscillation of the individual shaft 28.

Figure 18:
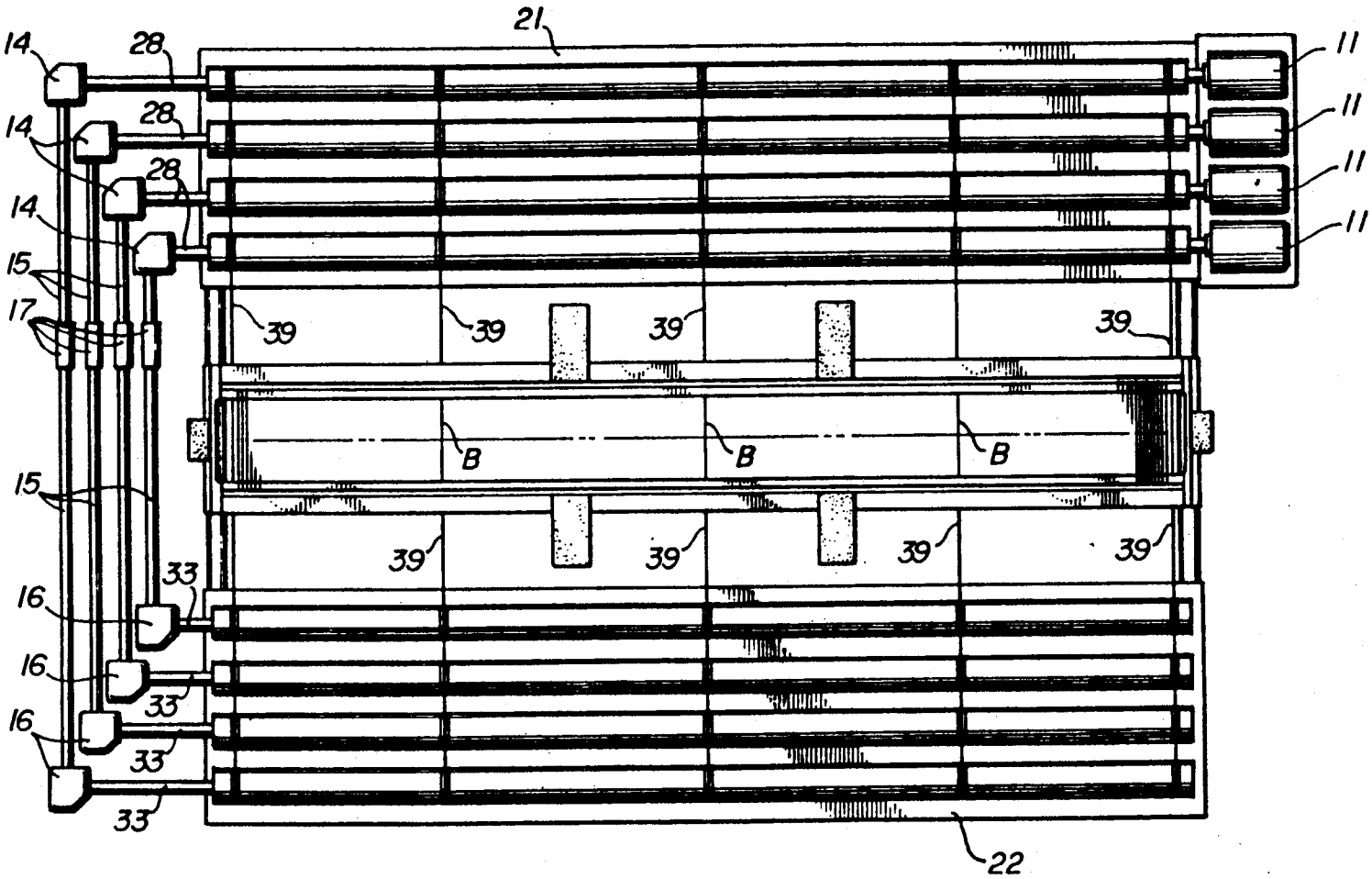
FIG. 18 is a perspective view of another embodiment of the present invention.

Another embodiment shown in FIG. 18, eliminates the use of control pulleys 36 and 37 and there associated cables 9B and 39C, respectively. Servo motors 11 are mechanically linked to shafts 28, however, at the other end of shafts 28, shafts 28 engage miter gear drive 14. Vertical torsion rods 15 also engage gear drive 14, therefore changing the axis of rotation of shaft 28 by 90 degrees. Portion rods 15 engage miter gear drive 16, to which also are engaged shafts 33 of lower plate 22. Thus, the oscillation of shafts 28 is communicated, thru miter gear drives 14 and 16, to shafts 33. The oscillation of both shafts 28 and 33 is controlled by A-C servo motors 11 in this manner. Adjustable tension means 17 for torsion rods 15, which are well known in the art, can also be included in torsion rods 15.

Figure 19:
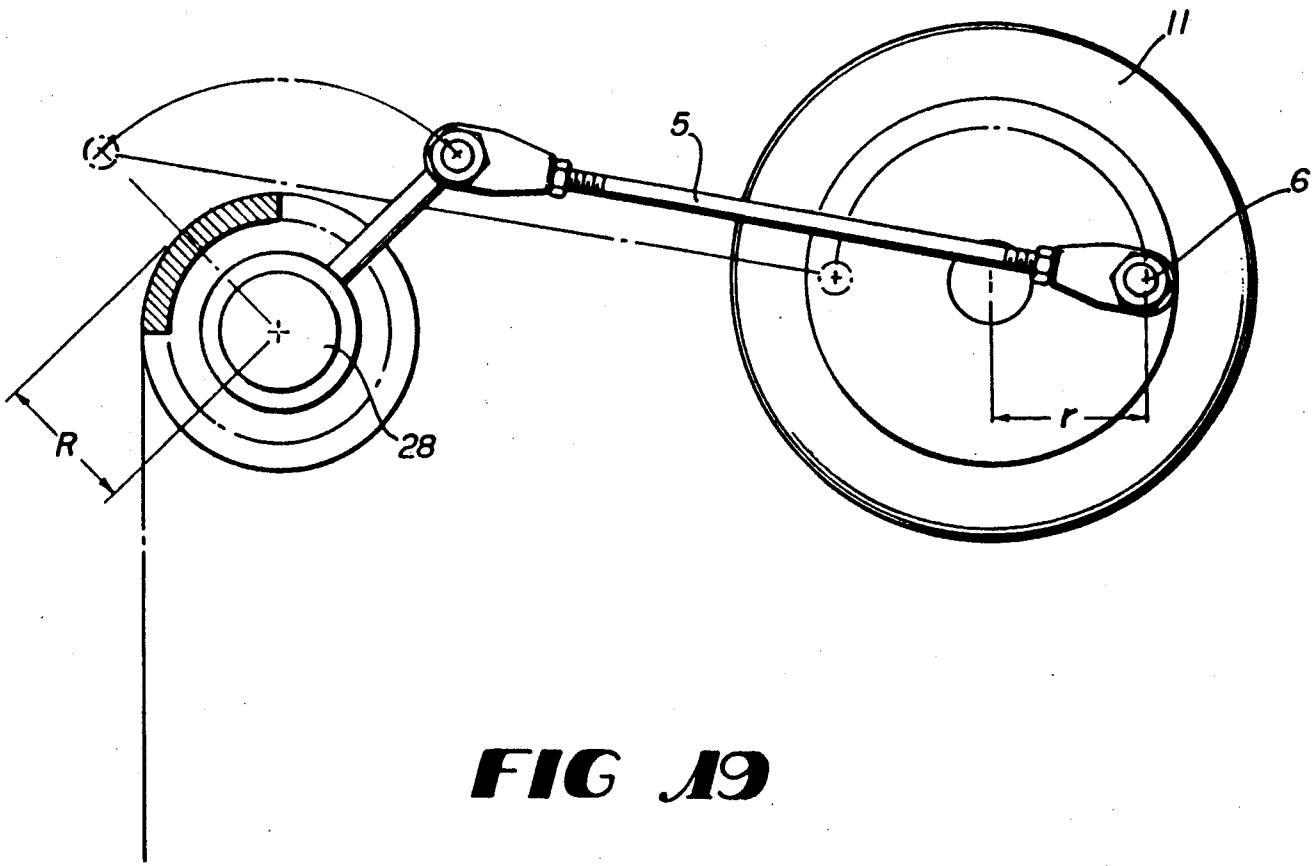
FIG. 19 is a schematized side view of an A-C servo motor, a shaft and pulley, and connecting linkage.

FIG. 19 shows in schematized form a side view of a servo motor 11 connected by mechanical linkage 5 to a shaft 28. When shafts 28 are rocked in this manner, as can be seen, the drive pin 6 of motor 11 is driven through an angle of approximately one hundred eighty degrees, while shafts 28 are normally driven through an angle of less than one hundred forty degrees, typically between one hundred degrees and one hundred twenty degrees. Those skilled in the art readily understand the linking of motors 11 mechanically to shafts 28.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. A loom harness having a pair rotatable elongated structural elements disposed about parallel axes, said elements having outer surfaces conforming to the shape of a cylinder and associated plane of linear movement tangent to each pair of said surfaces, a straight row of heddle eyes which are also parallel to said pair of parallel axes, independent flexible means for positioning said heddle eyes within the tangent plane, each pair of said elements with their parallel axes and associated tangent plane being arranged to take the form a scroll, and wherein said structural elements are supported along their respective parallel axes at least two locations, said locations being selected to minimize stress and deflection of said structural elements, and multiple scroll forms, each comprising a pair of rotatable structural elements with parallel axes and an associated tangent planes, said scroll forms being spaced sufficiently to permit nesting of the scroll forms in a manner such that the multiple associated tangent planes are parallel to each other and spaced one from the next by uniform spacing or gauge.

2. A loom harness as defined in claim 1, including means for rotating each rotatable, structural element of each pair of such elements in unison with the other through an angle not exceeding 360°, clockwise or counterclockwise, for causing the flexible means to wrap onto one surface and unwrap from the other surface, thus moving the row of heddle eyes in a linear manner, up or down, within the tangent pane, whereby rotary motion of the rotatable, structural elements in unison about their parallel axes is converted to linear movement of the row of heddle eyes within the tangent plane.

3. A loom harness as defined in claim 1, including upper and lower beams and wherein said rotatable structural elements are supported by upper and lower beams.

4. A loom harness as defined in claim 2, wherein said means for rotating each structural element comprises gears and shafts connected to said element.

5. A loom harness as defined in claim 2, wherein said means for rotating each rotatable structural element comprises arcuate means and flexible means connecting pairs of the elements.

6. A loom harness as defined in claim 2, wherein said means for rotating each rotatable structural element includes a dobby.

7. A loom harness as defined in claim 2, wherein said means for rotating each rotatable structural element includes a motor.

8. A loom harness as defined in claim 2, wherein said means for rotating each rotatable structural element includes a crank-type mechanism.

9. A loom harness as defined in claim 2, wherein said means for rotating each rotatable structural element includes means for connecting pair so said elements together for causing them to rotate in unison.

10. A loom harness as defined in claim 2, including tensioning means connected between pairs of said rotatable structural elements for establishing and maintaining tension forces in said flexible means.

11. A loom harness as defined in claim 2, wherein said means for rotating each rotatable structural element includes adjustable tensioning means for establishing and maintaining tension forces in said flexible means attached to each pair of rotatable structural elements.

12. A loom harness as defined in claim 2, including lightweight heddle frames carried by said flexible means, said frames each having parallel upper and lower heddle rods and heddles carried by said heddle rods, said rows of heddle eyes being located in said heddles.

13. A loom harness as defined in claim 12, wherein lightweight heddle frames are positioned an supported by said tensioned flexible means.

14. A loom harness as defined in claim 12, including tension center braces for maintaining parallelism of said upper and lower heddle rods against tension forces applied by said flexible means.

15. A loom harness as defined in claim 12, wherein said flexible means are spaced along the length of said rotatable structural elements to minimize stress and deflection of said heddle frames.

16. A loom harness as defined in claim 12, including tension center braces and wherein said frame includes end pieces and said parallel upper and lower heddle rods are connected to said end pieces and to said flexible means and said tension center braces controlling the stress and deflection associated with the forces of shedding.

17. A loom harness as defined in claim 12, and nose guides attached to said heddle frames.

18. A loom harness as defined in claim 12, and guide block means for slidably engaging said heddle frames.

19. A loom harness for moving warp yarns, comprising:

(a) a stationary, rigid frame;

(b) a first elongate cylinder means rotatably supported by said frame at two or more locations along said cylinder;

(c) a second elongate cylinder means rotatably supported by said frame parallel to said first cylinder means;
(d) cables attached at one end to said first cylinder means and at another end to said second cylinder means;
(e) a lightweight heddle frame supported by said cables;
(f) heddles carried by said lightweight heddle frames;
(g) a control cable attached to said first cylinder means and to said second cylinder means;
(h) control means attached to said control cables for moving said control cables; and
(i) said control means includes a dobby.

20. The loom harness defined in claim 19, wherein said motor means comprises a servo motor.

21. A loom harness for moving warp yarns, comprising:
(a) a stationary, rigid frame;
(b) a first elongate cylinder means rotatably supported by said frame at two or more locations along said cylinder;
(c) a second elongate cylinder means rotatably supported by said frame parallel to said first cylinder means;
(d) cables attached at one end to said first cylinder means and at another end to said second cylinder means;
(e) a lightweight heddle frame supported by said cables;
(f) heddles carried by said lightweight heddle frames;
(g) a control cable attached to said fist cylinder means and to said second cylinder means; and
(h) a nose guide attached to said heddle frame.

22. A loom harness for moving warp yarns which are progressively fed through the loom harness, comprising:
(a) a stationary, rigid frame;
(b) a pair or elongate, parallel cylinders rotatably attached to said frame at two or more locations along said cylinders;
(c) flexible means each attached at one end to one of said cylinders, and at another end to the other of said cylinders;
(d) mail eyes attached to said flexible means;
(e) oscillation means for rotating said cylinders either in a clockwise or in a counterclockwise direction; and
(f) said oscillation means including control cables attached at one end to one of said cylinders and at another end to the other of said cylinders;
(g) control means for controlling said oscillation means; and
(h) said control means including drive shafts connected to said cylinders, and motor means connected to said drive shafts for moving said drive shafts.

23. The loom harness defined in claim 22, wherein said motor means includes a servo motor.

24. The loom harness as defined in claim 22, said motor means driving said cylinder through a crank-type mechanism.

25. A loom harness for moving warp yarns which are progressively fed through the loom harness, comprising:
(a) a stationary, rigid frame;
(b) a pair of elongate, parallel cylinders rotatably attached to said frame at two or more locations along said cylinders;
(c) flexible means each attached at one end to one of said cylinders, and at another end to the other of said cylinders;
(d) mail eyes attached to said flexible means;
(e) oscillation means for rotating said cylinders either in a clockwise or in a counterclockwise direction; and
(f) said oscillation means including control cables attached at one end to one of said cylinders and at another end to the other of said cylinders;
(g) control means for controlling said oscillation means; and
(h) multiple pairs of said elongate cylinders being attached to said frame.

26. The loom harness defined in claim 25, wherein said multiple pairs of said elongate cylinders are disposed in parallel relationship to one another.

27. The loom harness defined in claim 25, wherein each pair of said elongate cylinders includes flexible means connected at one end to one of said cylinders and at another end to another of said cylinders.

28. A loom harness for moving warp yarns which are progressively fed through the loom harness, comprising:
(a) a stationary, rigid frame having an upper beam and a lower beam between which are passed said warp yarns;
(b) a plurality of upper shafts disposed in parallel relationship and adjacent to said upper beam;
(c) a plurality of lower shafts disposed in parallel relationship and adjacent to said lower beam;
(d) a plurality of pillow blocks mounted in spaced relationship on said upper beam for journalling each of said upper shafts at spaced intervals along the length of each of said upper shafts;
(e) a plurality of additional pillow blocks mounted in spaced relationship on said lower beam for journalling each of said lower shafts at spaced intervals along the length of each of said lower shafts;
(f) upper arcuate means mounted on each of said upper shafts;
(g) lower arcuate means mounted on each of said lower shafts;
(h) said upper arcuate means having upper arcuate surfaces concentric with their respective upper shafts;
(i) said lower arcute means having lower arcuate surfaces concentric with their respective lower shafts;
(j) a plurality of vertically extending, transversely spaced flexible members extending between certain of said upper arcuate surfaces of each upper shaft and certain of said lower arcuate surfaces on corresponding lower shafts;
(k) lightweight heddle frames carried by said flexible members;
(l) heddles having yarn eyes through which said warp yarns pass, carried by said lightweight heddle frames; and
(m) means for rocking the upper shafts and their respective corresponding lower shafts for moving said eyes in accordance with a weave design.

29. The loom harness defined in claim 28, wherein said upper shafts are disposed adjacent to said upper beam in offset relationship.

30. The loom harness defined in claim 28, wherein said lower shafts are disposed adjacent to said lower beam in offset relationship.

31. The loom harness defined in claim 28, wherein said upper arcuate means comprise pulleys.

32. The loom harness defined in claim 28, wherein said lower arcuate means comprises pulleys.

33. A loom harness as defined in claim 28, wherein said tranversely spaced flexible members and their associated upper and lower arcuate means are spaced along said upper and lower shafts to minimize stress and deflection in said lightweight heddle frames during shedding.

34. The loom harness defined in claim 28, wherein said means for rocking includes a dobby.

35. The loom harness defined in claim 28, wherein said means for rocking include drive means connected to said upper shaft and said lower shaft and motor means connected to said drive means.

36. The loom harness as defined in claim 35, wherein said motor means includes a servo motor and controller.

37. The loom harness as defined in claim 35, wherein said motor means includes a crank-type mechanism.

38. A method of manipulating warp yarns fed to a loom for producing a weave design comprising:

(a) disposing flexible elements over opposed upper and lower arcuate surfaces which in turn are disposed along parallel axes in said loom for forming a plurality of scrolls supported by said arcuate surfaces, said scrolls having the flexible elements in parallel, upright, tranversely extending adjacent planes tangent to said arcuate surfaces;

(b) supporting eyes by said flexible elements in the planes of said scrolls for movement upwardly and downwardly in the parallel, transverse planes of said flexible elements;

(c) rocking said arcuate surfaces about their respective axes for applying tension to said flexible members while imparting reciprocating motion to the flexible elements along the plane of each scroll so that each of said eyes are pulled upwardly or pulled downwardly by said flexible elements; and (d) progressively feeding warp yarns respectively through said eyes for weaving action of the loom while moving the eyes of one plane in one direction and moving the eyes of an adjacent plane in the other direction for separating the warp for forming a shed.

39. The method defined in claim 38, wherein said shafts are rocked through an angle of less than 180 degrees.

40. The method defined in claim 38, wherein said arcuate surface means comprises pulleys.

41. A manipulating method as defined in claim 38 including rotating a pair of arcuate surfaces in unison.

42. A manipulating method as defined in claim 38, including applying tension to said flexible members externally of the warp yarns.

* * * * *